US012398947B2

(12) United States Patent
Burns et al.

(10) Patent No.: US 12,398,947 B2
(45) Date of Patent: Aug. 26, 2025

(54) REFRIGERATION APPLIANCE WITH A DOOR PROJECTION TO REDUCE THERMAL TRANSFER AT DOOR AND CABINET INTERFACE

(71) Applicant: WHIRLPOOL CORPORATION, Benton Harbor, MI (US)

(72) Inventors: John J. Burns, Saint Joseph, MI (US); Jackson F. Karl, Stevensville, MI (US); Marcel Lessa, Joinville (BR); Chad Rotter, Saugatuck, MI (US); Sanket Vivek Phalak, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 201 days.

(21) Appl. No.: 18/224,928

(22) Filed: Jul. 21, 2023

(65) Prior Publication Data

US 2025/0027705 A1 Jan. 23, 2025

(51) Int. Cl.

| | |
|---|---|
| ***F25D 23/06*** | (2006.01) |
| ***F25D 23/02*** | (2006.01) |
| ***F25D 23/08*** | (2006.01) |

(52) U.S. Cl.

CPC ..... *F25D 23/062* (2013.01); *F25D 23/02* (2013.01); *F25D 23/028* (2013.01); *F25D 23/066* (2013.01); *F25D 23/085* (2013.01)

(58) Field of Classification Search

CPC .... F25D 23/062; F25D 23/066; F25D 23/085; F25D 23/028; F25D 23/065; F25D 23/087; F25D 23/02

See application file for complete search history.

(56) References Cited

U.S. PATENT DOCUMENTS

| | | | | |
|---|---|---|---|---|
| 2,345,743 | A | 4/1944 | Gaston | |
| 3,359,053 | A | 12/1967 | Hagendorn | |
| 4,469,383 | A | 9/1984 | Losert | |
| 4,653,819 | A | 3/1987 | Swerbinsky | |
| 4,916,864 | A | 4/1990 | Thompson | |
| 5,533,311 | A * | 7/1996 | Tirrell | E06B 7/2312 49/501 |
| 6,266,970 | B1 | 7/2001 | Nam et al. | |
| 8,083,305 | B2 | 12/2011 | Lee et al. | |
| 10,563,905 | B1 * | 2/2020 | Allard | F25D 23/085 |
| 10,753,669 | B2 * | 8/2020 | Dherde | F25D 23/065 |

(Continued)

FOREIGN PATENT DOCUMENTS

| | | | |
|---|---|---|---|
| GB | 725546 | A1 | 3/1955 |
| JP | S613387 | U | 1/1986 |

(Continued)

*Primary Examiner* — Kimberley S Wright
(74) *Attorney, Agent, or Firm* — Price Heneveld LLP

(57) ABSTRACT

A refrigeration appliance including: (a) a cabinet that includes a vacuum-insulated structure within which a refrigeration compartment configured to hold a food item is disposed; and (b) a door that includes a vacuum-insulated door structure coupled to the cabinet, the vacuum-insulated door including (i) a gasket that forms a seal against the vacuum-insulated cabinet when the door is in a closed position and (ii) a projection inward of the gasket that projects into the refrigeration compartment and is separated from the vacuum-insulated cabinet by a gap, the gap having a shortest distance that is less than 12 mm.

20 Claims, 13 Drawing Sheets

(56) References Cited

U.S. PATENT DOCUMENTS

| | | | | |
|---|---|---|---|---|
| 10,807,298 | B2 * | 10/2020 | Allard | F25D 23/064 |
| 10,837,697 | B2 * | 11/2020 | Amorim | B29C 45/0001 |
| 11,320,193 | B2 * | 5/2022 | Visin | F25D 23/085 |
| 11,577,446 | B2 * | 2/2023 | Allard | B29C 51/082 |
| 2003/0222553 | A1 * | 12/2003 | Lee | F25D 23/087 312/405 |
| 2009/0007587 | A1 | 1/2009 | Lanzi et al. | |
| 2018/0311884 | A1 * | 11/2018 | Allard | B65D 81/3823 |
| 2019/0101320 | A1 * | 4/2019 | Dherde | F25D 23/069 |
| 2019/0128591 | A1 * | 5/2019 | Visin | F25D 23/02 |
| 2020/0132359 | A1 * | 4/2020 | Amorim | B29C 45/0046 |
| 2020/0406527 | A1 * | 12/2020 | Allard | B29C 51/02 |
| 2021/0207878 | A1 * | 7/2021 | Deka | F25D 23/085 |
| 2021/0348831 | A1 * | 11/2021 | Kapure | F25D 23/082 |
| 2022/0252333 | A1 | 8/2022 | Awachat et al. | |

FOREIGN PATENT DOCUMENTS

| | | | |
|---|---|---|---|
| JP | 2012202582 | A | 10/2012 |
| KR | 20030094550 | A | 12/2003 |

* cited by examiner

REFRIGERATION APPLIANCE WITH A DOOR PROJECTION TO REDUCE THERMAL TRANSFER AT DOOR AND CABINET INTERFACE

BACKGROUND OF THE DISCLOSURE

The present disclosure generally relates to a refrigeration appliance, and more specifically, to a refrigeration appliance with a door with a projection that extends into a cabinet to reduce air flow and thus thermal transfer to and through an interface of the door and the cabinet.

Refrigeration appliances are used to maintain a food item at a temperature below a temperature of an external environment (e.g., room temperature). Sometimes the refrigeration appliance includes a door that is attached to a cabinet, which forms a refrigeration compartment that holds the food item. In addition, sometimes the door of the refrigeration appliance includes a vacuum-insulated structure.

However, there is a problem in that thermal transfer from the refrigeration compartment within the cabinet to the external environment across an interface between the door and the cabinet is suboptimally high. The greater the thermal transfer across the interface, the more the refrigeration appliance has to work to maintain the temperature of the refrigeration compartment (and the food item). The more the refrigeration appliance has to work, the more electricity the refrigeration appliance consumes.

SUMMARY OF THE DISCLOSURE

The present disclosure addresses the aforementioned problem with a projection of the door that extends into a refrigeration compartment of the cabinet to form a narrow gap between the projection and the cabinet that reduces air flow toward, and thus thermal transfer through, the interface between the door and the cabinet.

According to one aspect of the present disclosure, a refrigeration appliance comprises: (a) a cabinet comprising (i) a forward surface that is substantially vertical, (ii) interior surfaces defining a refrigeration compartment configured to hold a food item, and (iii) an opening into the refrigeration compartment disposed inward of the forward surface; and (b) a door coupled to the cabinet, the door comprising (i) a closed position that denies access through the opening and into the refrigeration compartment of the cabinet from an external environment, (ii) an open position that allows access through the opening to the refrigeration compartment from the external environment, the door being movable to, from, and between the closed position and the open position, (iii) an inner liner facing the refrigeration compartment when the door is in the closed position, (iv) an outer wrapper separated from the inner liner by a space, and (v) a trim breaker coupled to both the inner liner and the outer wrapper, the trim breaker comprising a projection that extends rearward into the refrigeration compartment of the cabinet, when the door is in the closed position, wherein, the projection of the trim breaker opposes one or more of the interior surfaces of the cabinet defining the refrigeration compartment, when the door is in the closed position, but is separated therefrom by a gap.

According to another aspect of the present disclosure, a refrigeration appliance comprises: (a) a cabinet that comprises a vacuum-insulated structure within which a refrigeration compartment configured to hold a food item is disposed; and (b) a door that comprises a vacuum-insulated door structure coupled to the cabinet, the vacuum-insulated door comprising (i) a gasket that forms a seal against the vacuum-insulated cabinet when the door is in a closed position and (ii) a projection inward of the gasket that projects into the refrigeration compartment and is separated from the vacuum-insulated cabinet by a gap, the gap having a shortest distance that is less than 12 mm.

These and other features, advantages, and objects of the present disclosure will be further understood and appreciated by those skilled in the art by reference to the following specification, claims, and appended drawings.

Figure 1:
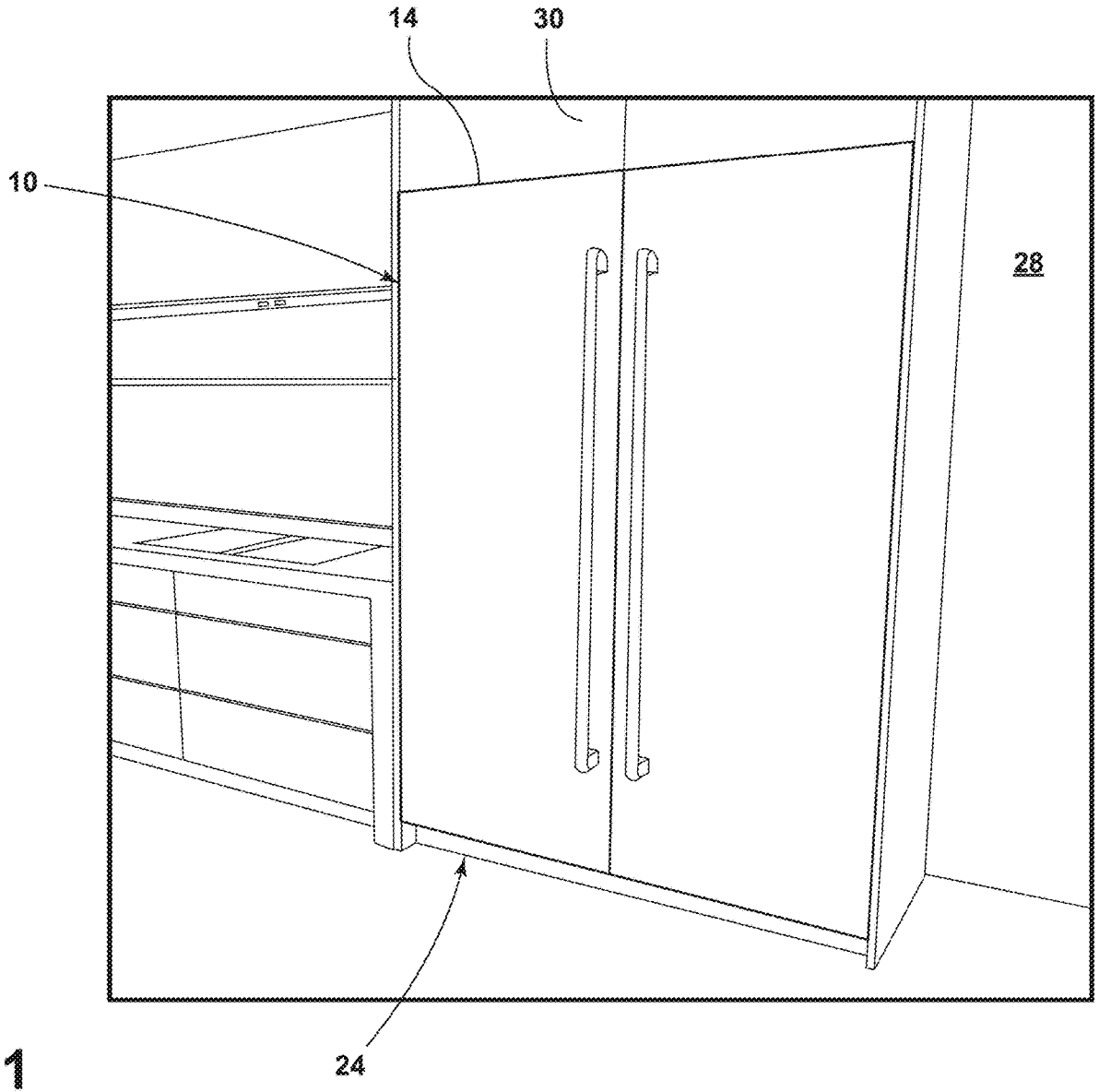
FIG. 1 is a perspective view of a refrigeration appliance of the present disclosure built into cabinetry with a door in the closed position.

The components in the figures are not necessarily to scale, emphasis instead being placed upon illustrating the principles described herein.

DETAILED DESCRIPTION

The present illustrated embodiments reside primarily in combinations of method steps and apparatus components related to a refrigeration appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Figure 2:
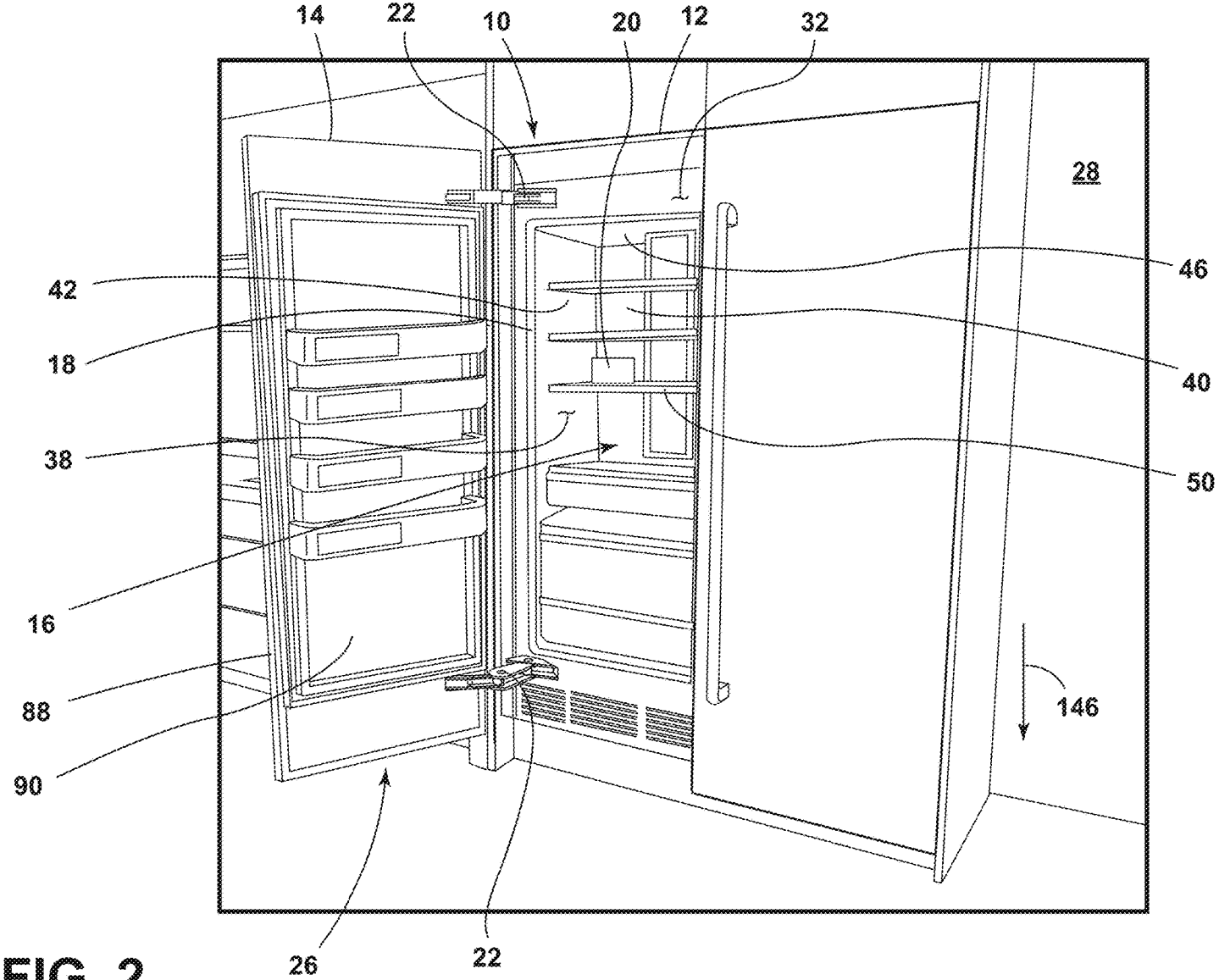
FIG. 2 is a perspective view of the refrigeration appliance of FIG. 1, illustrating the door in an open position to reveal a cabinet with a refrigeration compartment.
Figure 3:
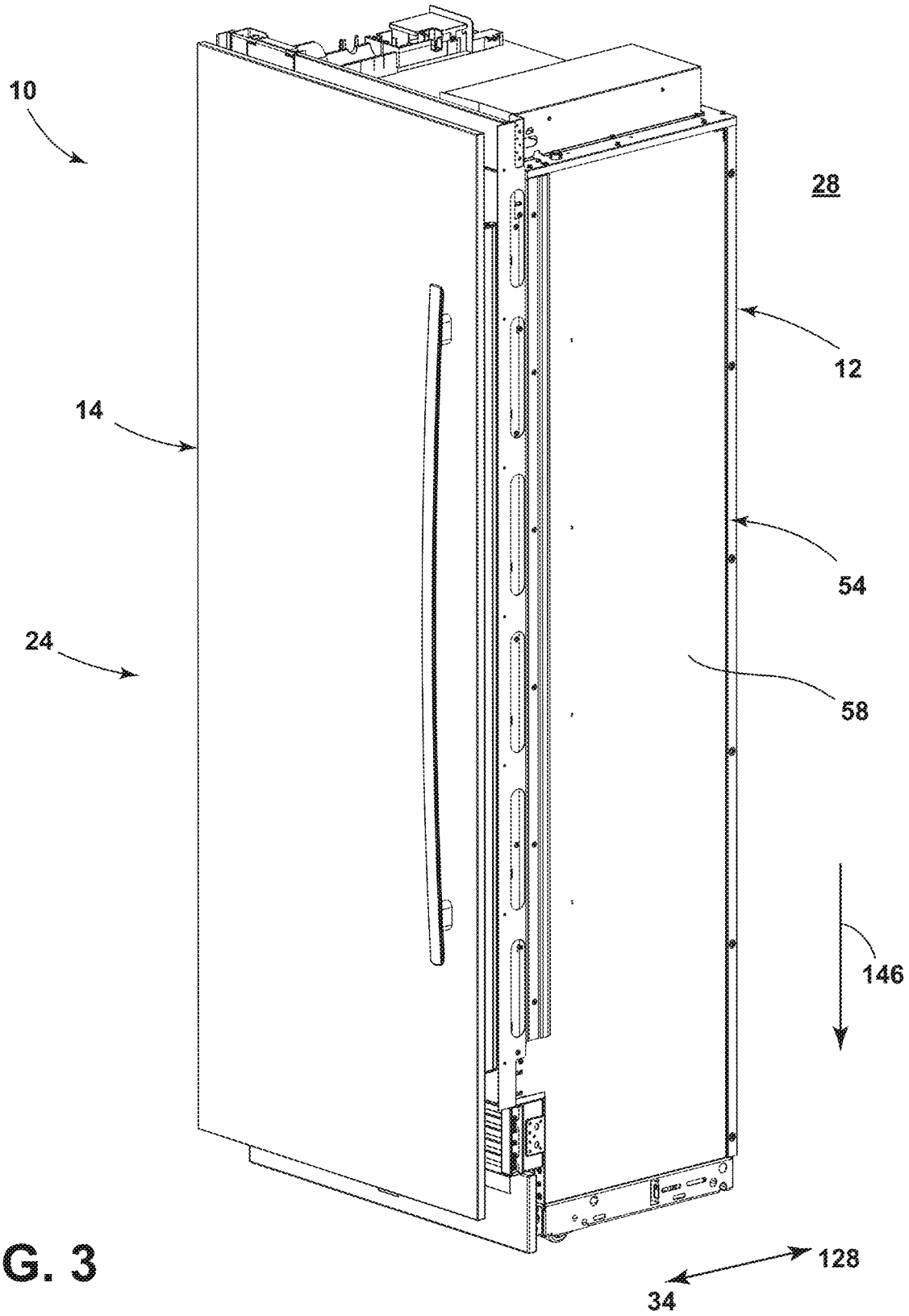
FIG. 3 is a perspective view of the refrigeration appliance of FIG. 1, illustrating the cabinet including a vacuum-insulated structure.
Figure 4:
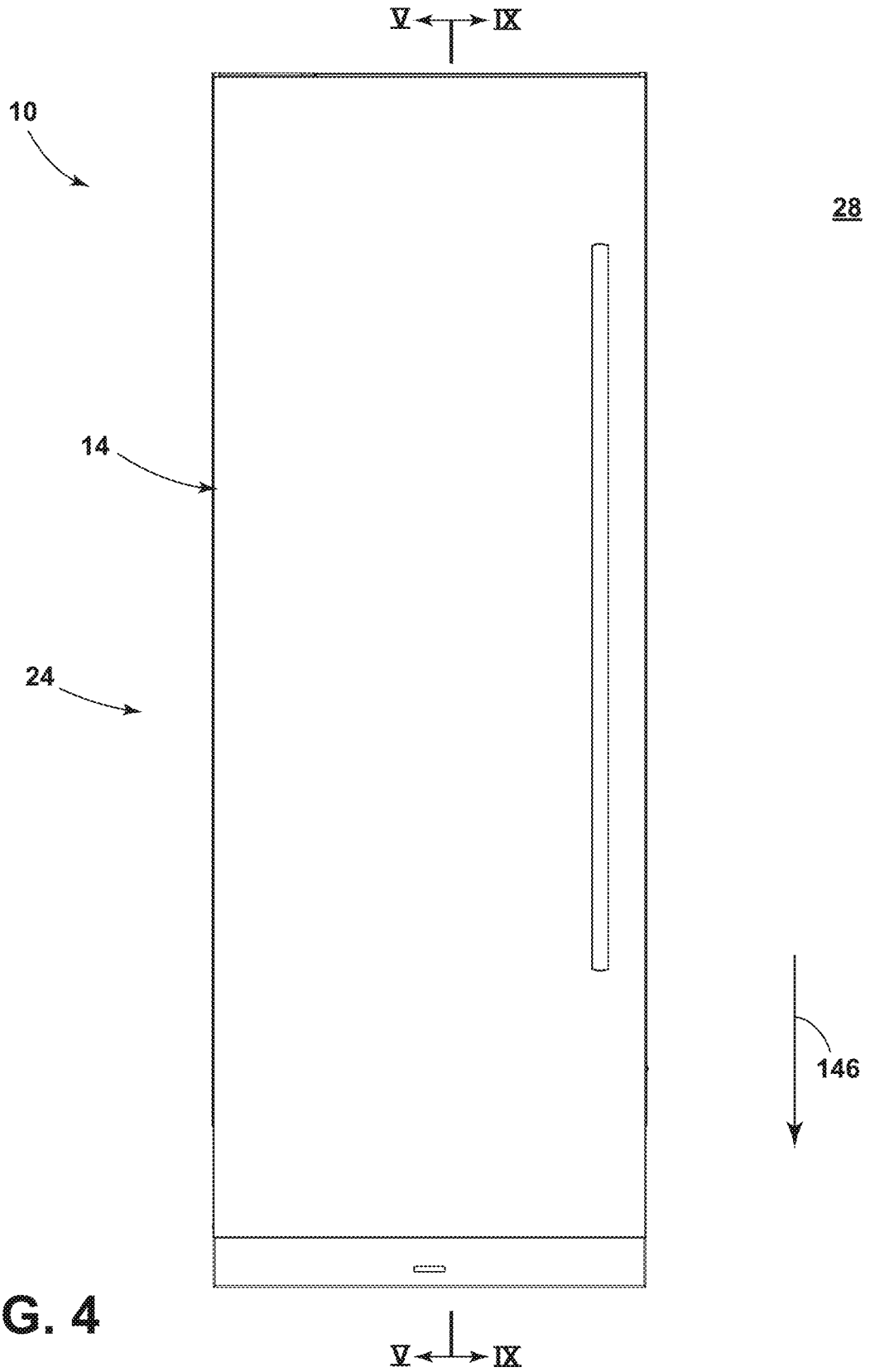
FIG. 4 is a front elevational view of the refrigeration appliance of FIG. 1.
Figure 5:
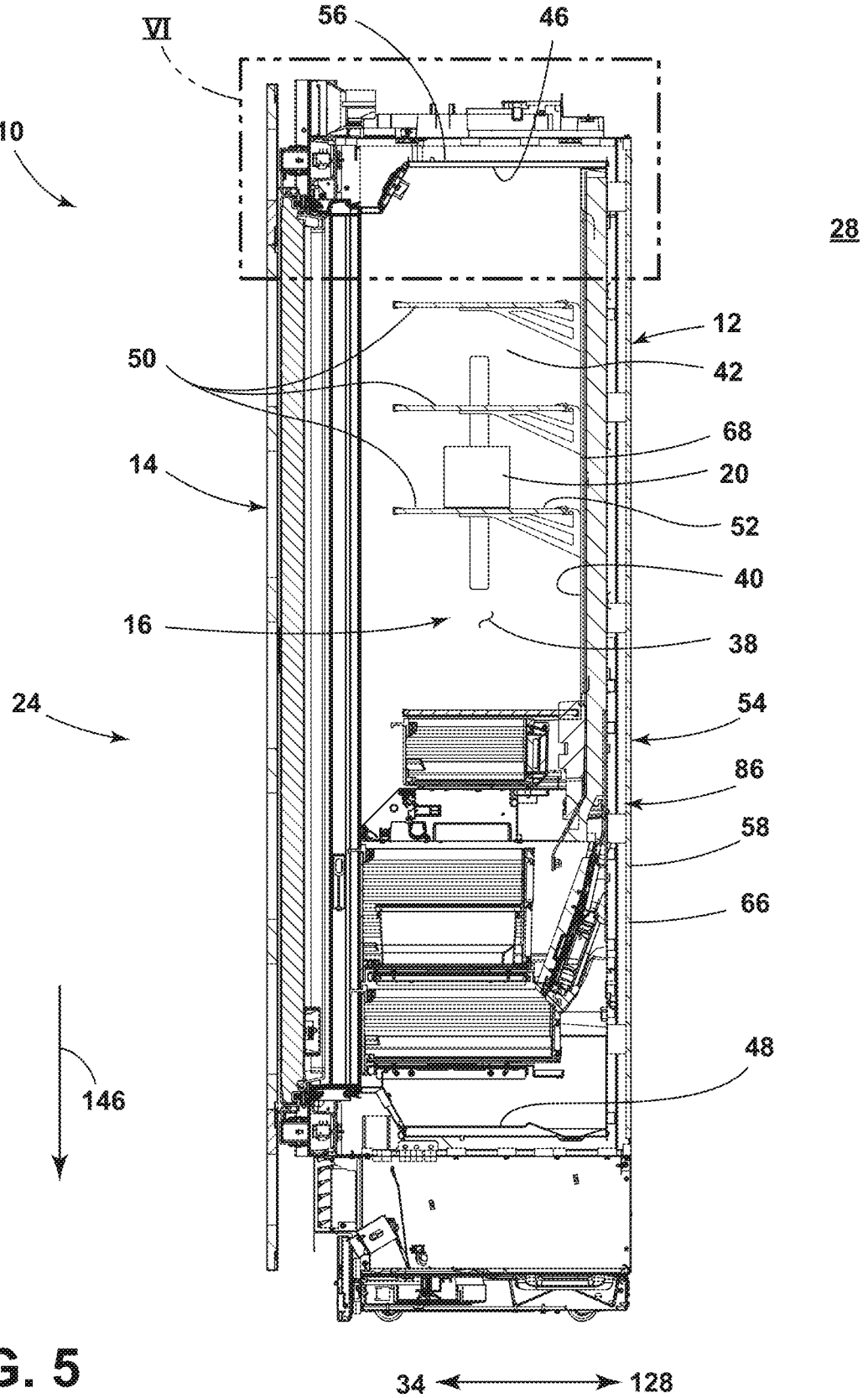
FIG. 5 is an elevational view of a cross-section of the refrigeration appliance of FIG. 1 taken through line V-V of FIG. 4, illustrating the vacuum-insulated structure of the cabinet including an outer wrapper and an inner liner defining at least in part the interior surfaces of the refrigeration compartment.
Figure 6:
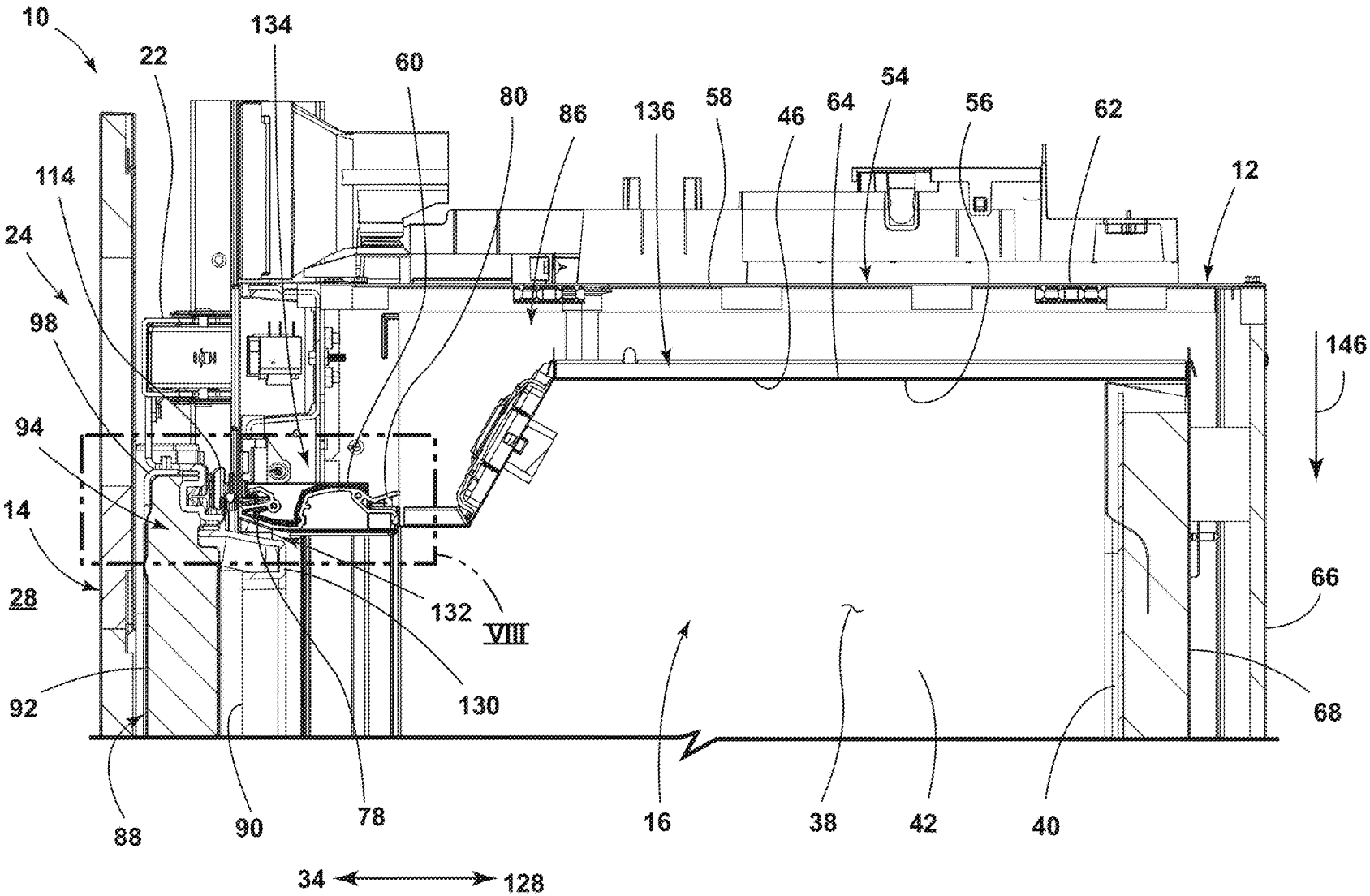
FIG. 6 is a magnified view of area VI of FIG. 5, illustrating the door of the refrigeration appliance of FIG. 1 also including a vacuum-insulated structure with an outer wrapper, an inner liner, and a trim breaker coupled to both the outer wrapper and the inner liner.
Figure 7:
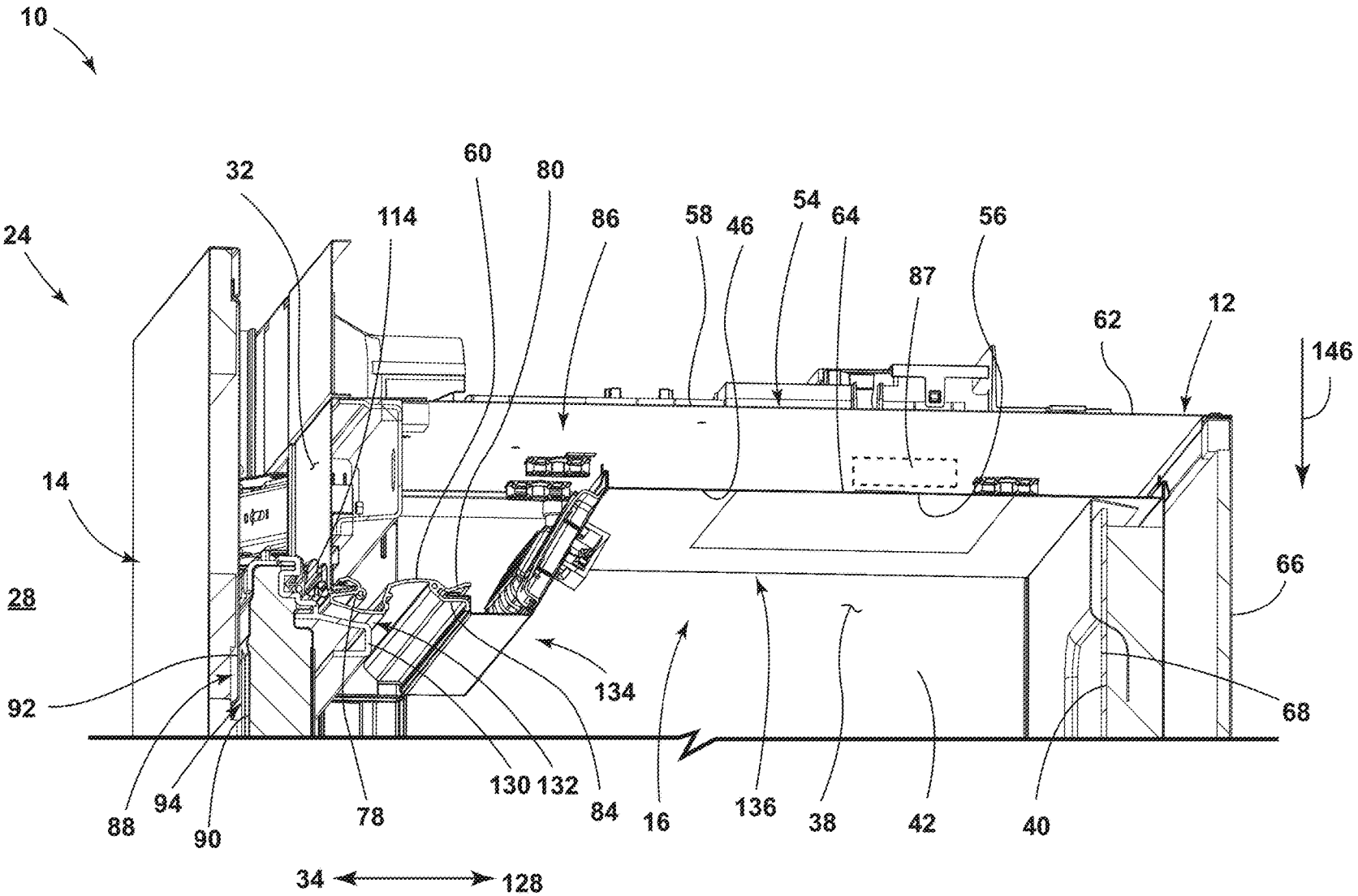
FIG. 7 is the same view as FIG. 6 but from a slight perspective, illustrating the vacuum-insulated structure of the cabinet further including a trim breaker coupled to both the outer wrapper and the inner liner of the vacuum-insulated structure of the cabinet.
Figure 8:
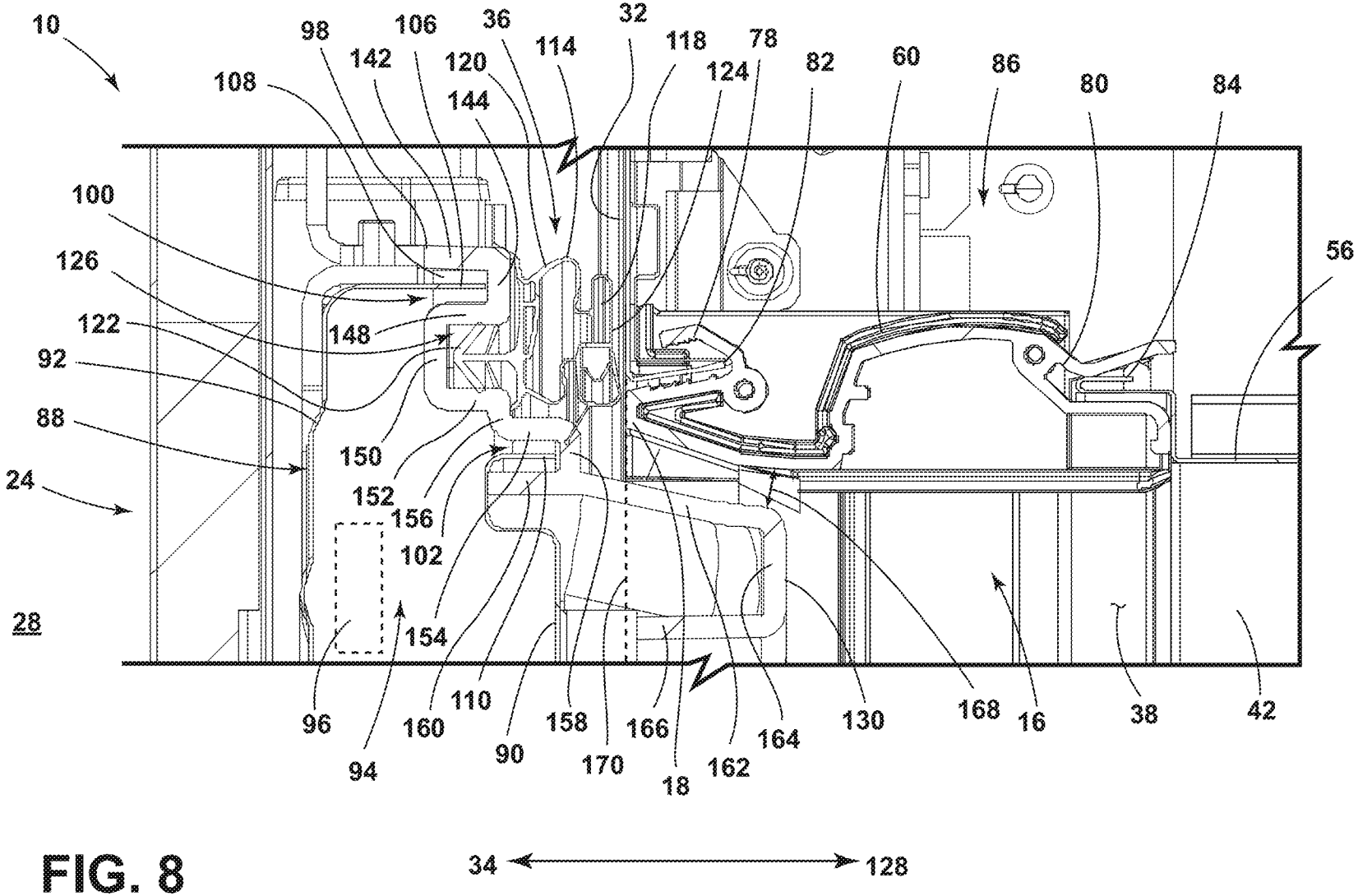
FIG. 8 is a magnified view of area VIII of FIG. 6, illustrating (i) the door further including a gasket forming a seal against a forward surface of the cabinet provided by the outer wrapper and (ii) the trim breaker of the vacuum-insulated structure of the door including a projection that extends rearward into the refrigeration compartment of the cabinet and separated from the trim breaker of the vacuum-insulated structure of the cabinet by a gap of relatively small proportions to reduce air flow from deeper within the refrigeration cabinet to the seal (e.g., interface) between the door and the cabinet that the gasket forms.
Figure 9:
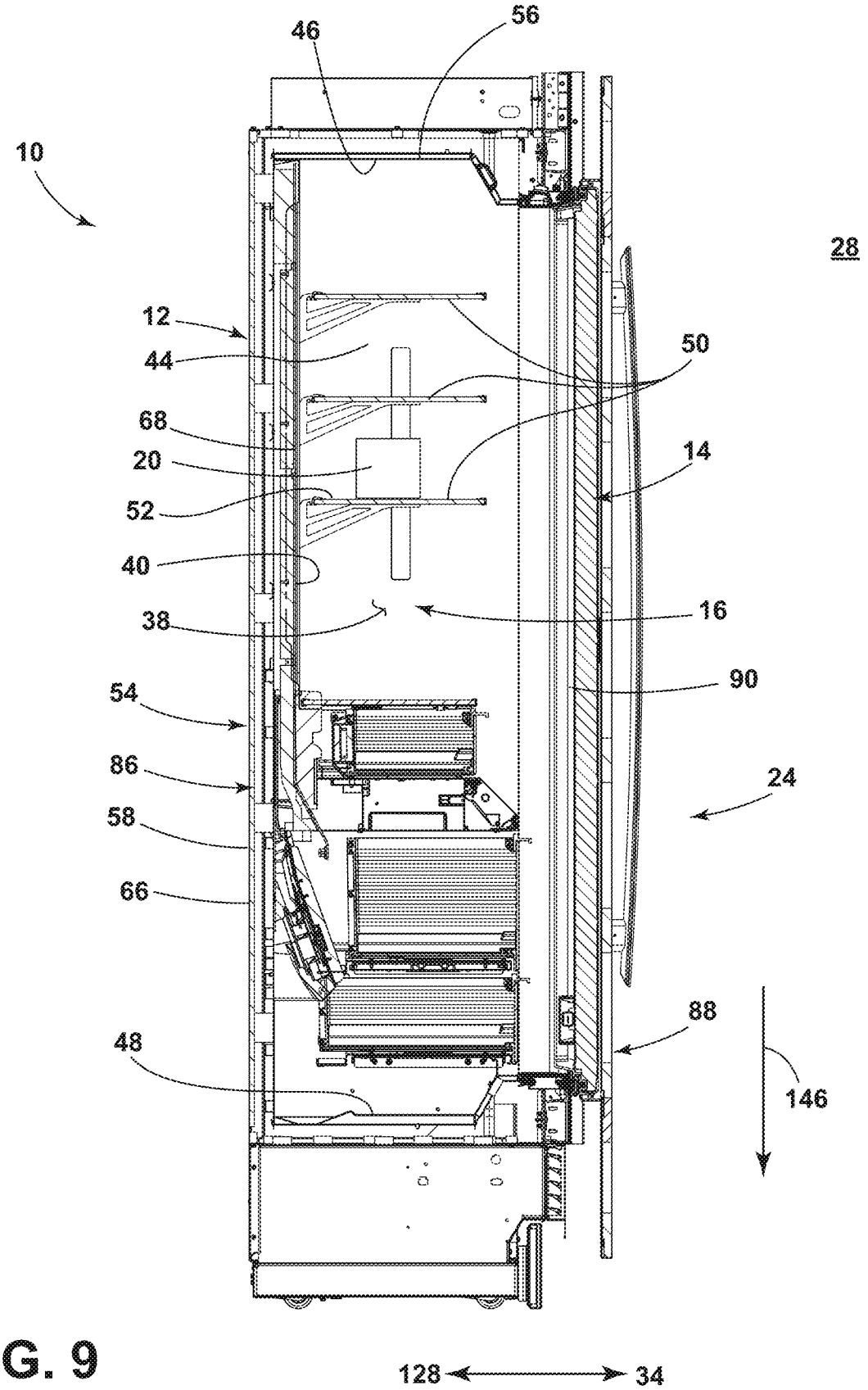
FIG. 9 is an elevation view of a cross-section of the refrigeration appliance of FIG. 1 taken through line IX-IX of FIG. 4, illustrating the inner liner of the vacuum-insulated structure of the cabinet providing at least a portion of the interior surfaces defining the refrigeration compartment.
Figure 10:
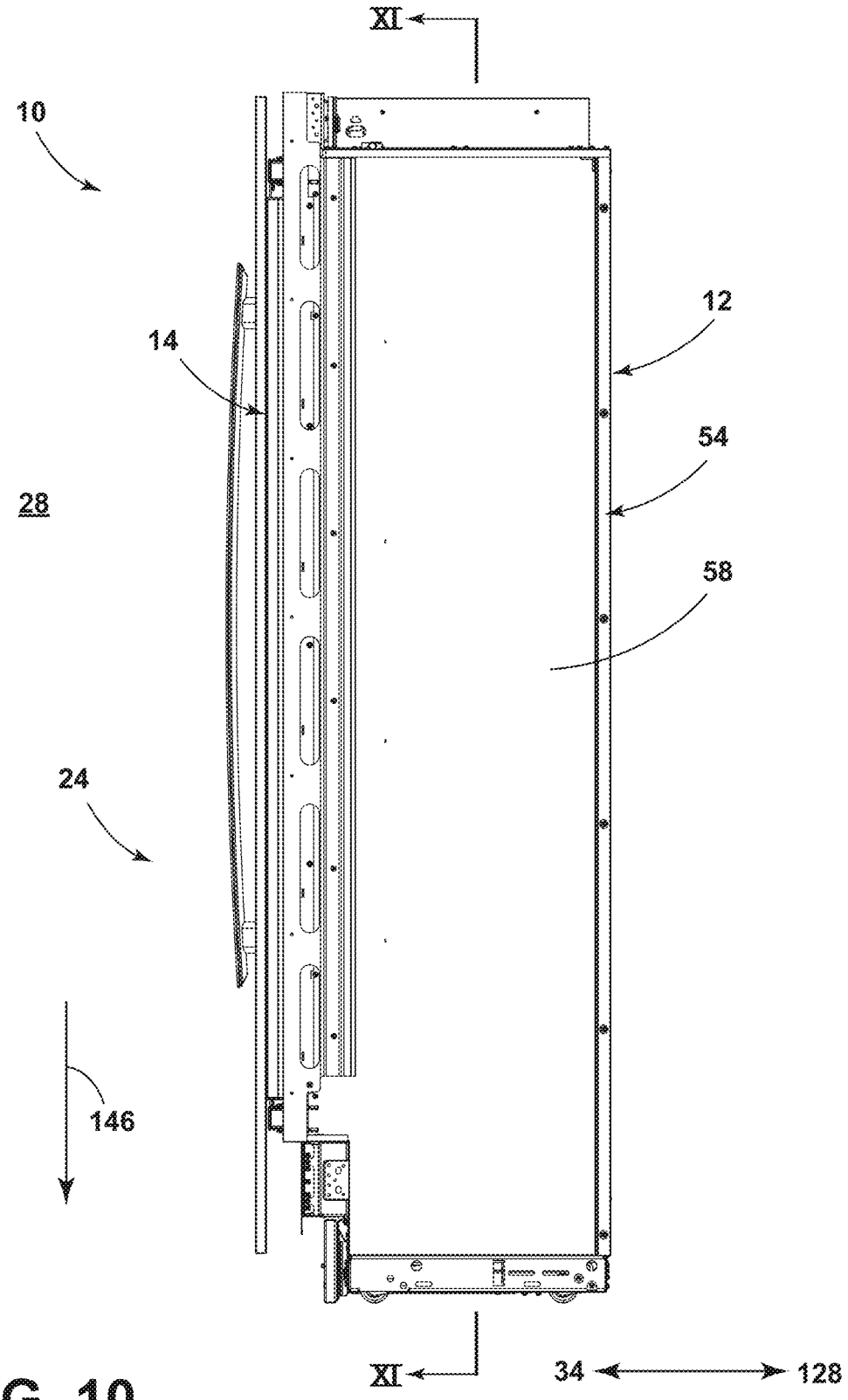
FIG. 10 is a side elevation view of the refrigeration appliance of FIG. 1.
Figure 11:
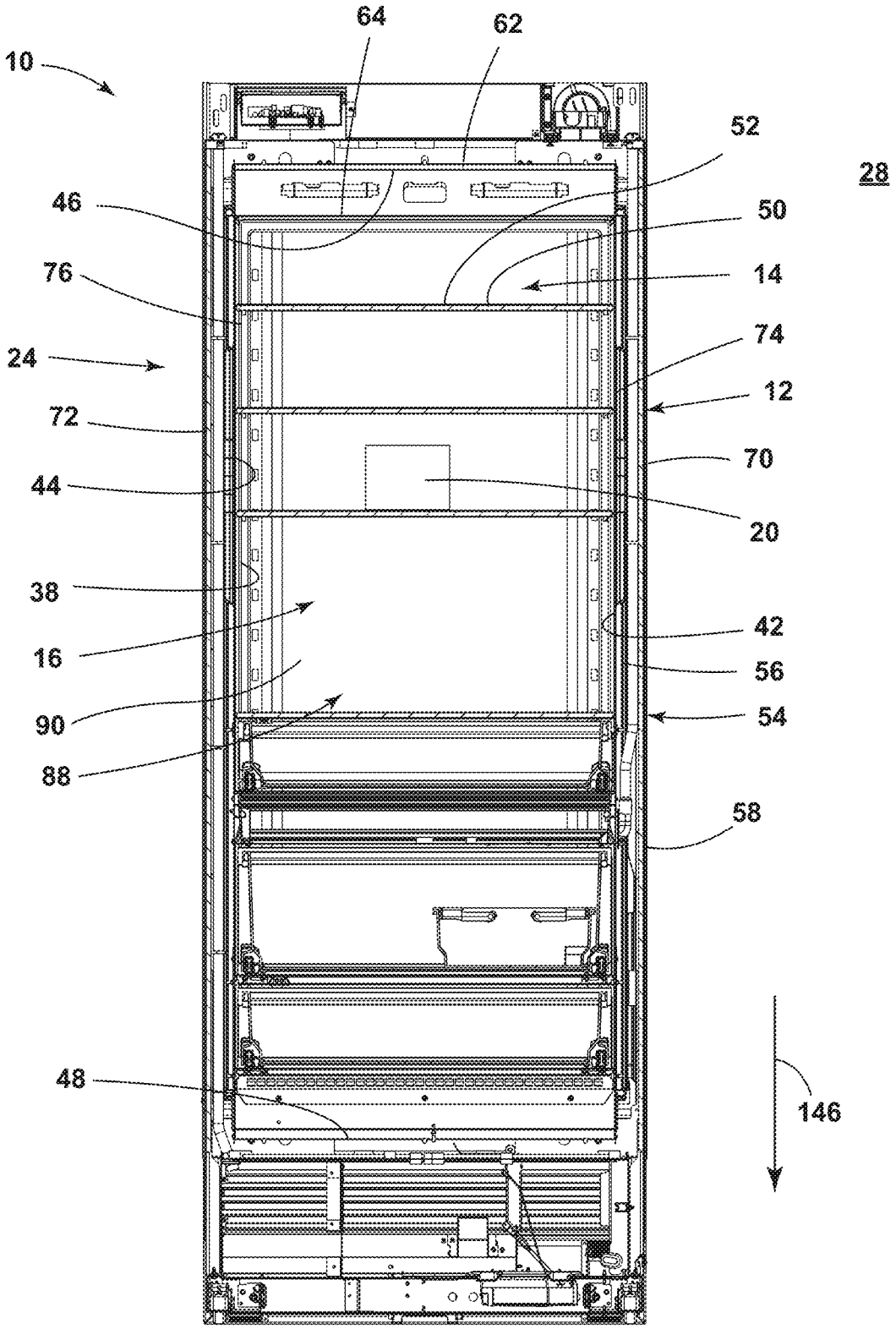
FIG. 11 is an elevation view of a cross-section of the refrigeration appliance of FIG. 1 taken through line XI-XI of FIG. 10, illustrating the inner liner of the vacuum-insulated structure of the cabinet providing the sidewalls, ceiling, and floor of the refrigeration compartment.
Figure 12:
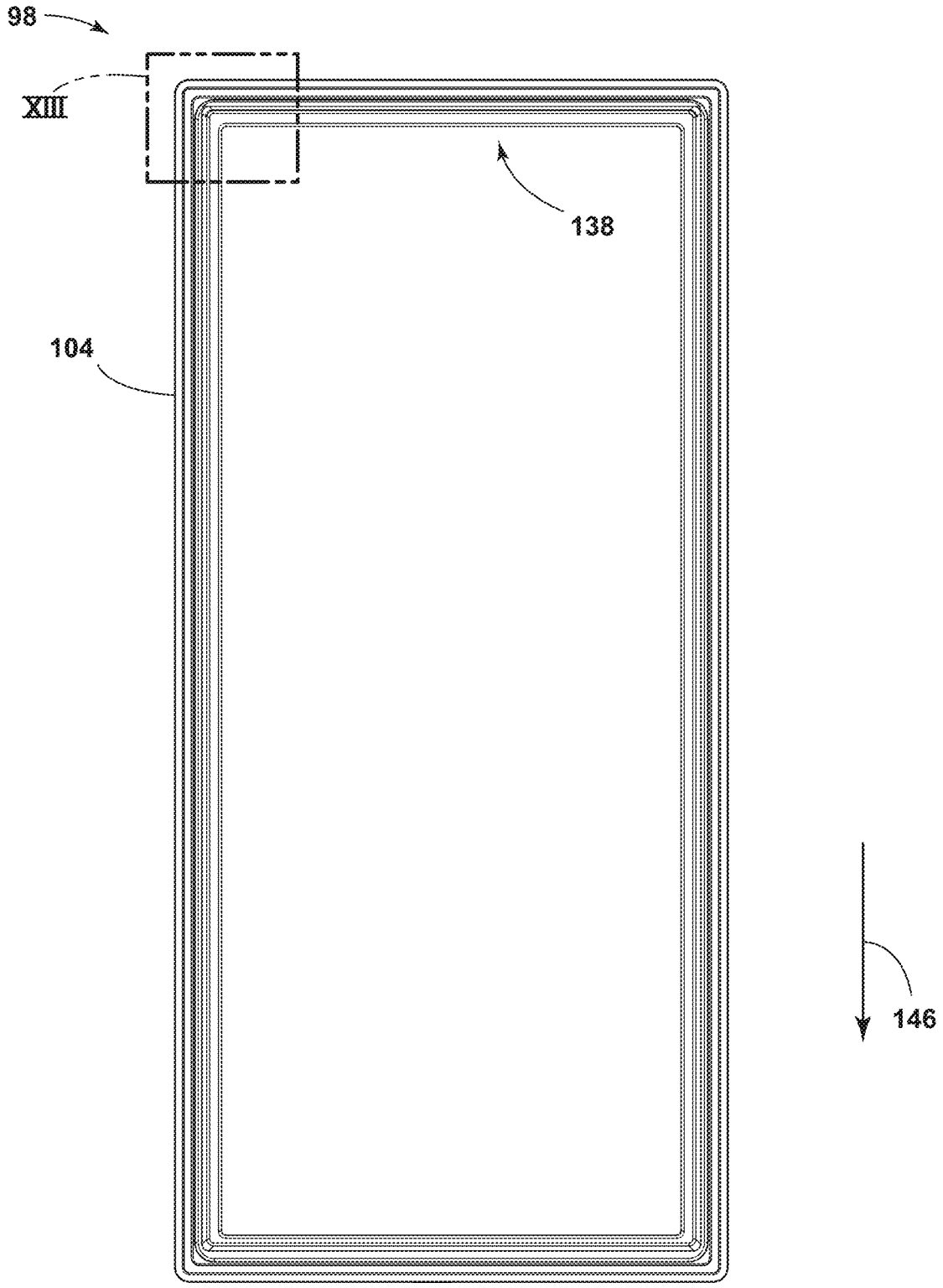
FIG. 12 is an elevation view of the trim breaker of the vacuum-insulated structure of the door.
Figure 13:
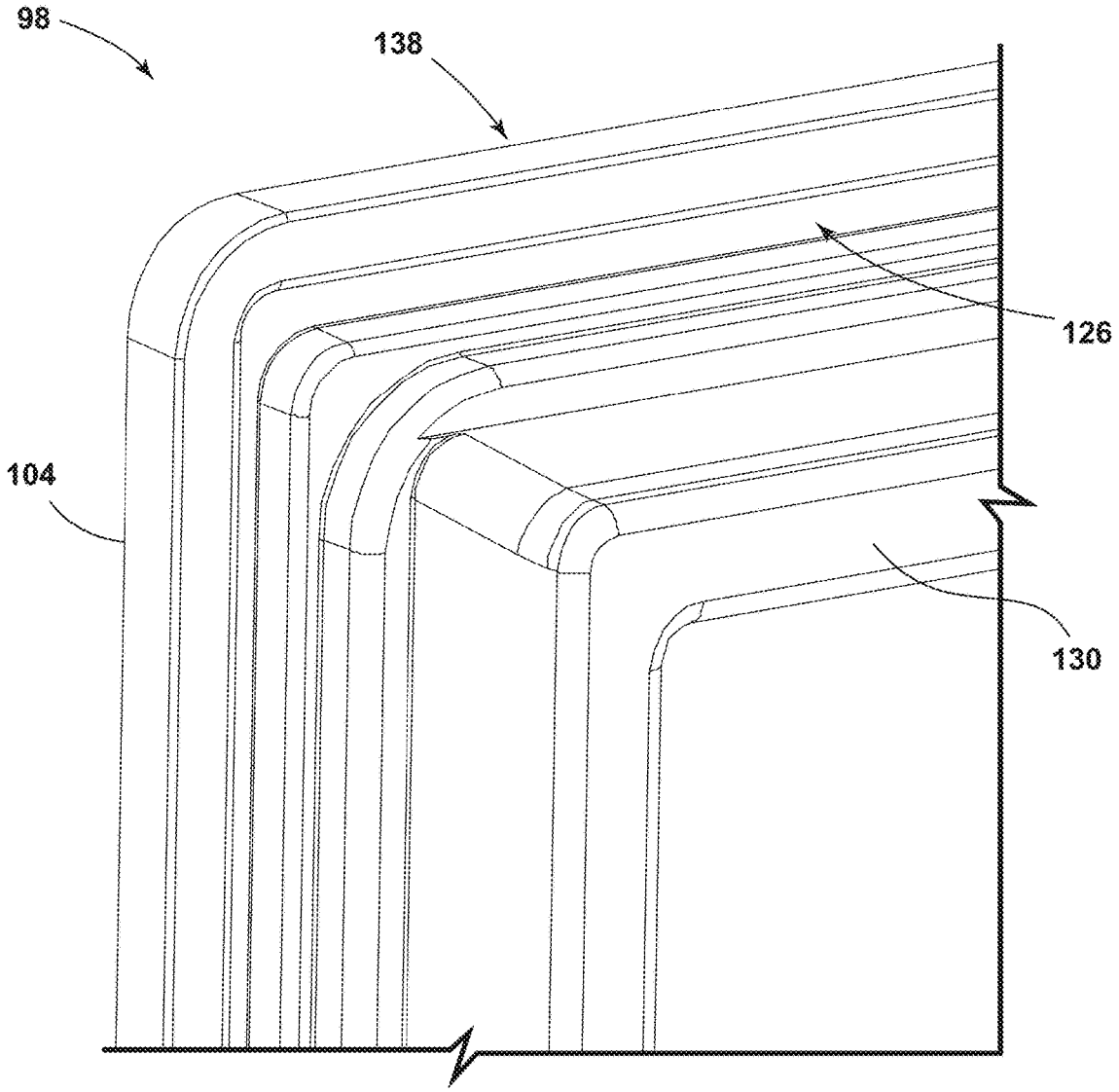
FIG. 13 is a magnified perspective view of area XIII of FIG. 12, illustrating the trim breaker of the vacuum-insulated structure of the door further including an outer perimeter, a rear recess inward of the outer perimeter, and the projection inward of the rear recess.

Referring to FIGS. 1 and 2, a refrigeration appliance 10 includes a cabinet 12 and a door 14. The cabinet 12 includes a refrigeration compartment 16 and an opening 18 into the refrigeration compartment 16. The refrigeration compartment 16 is configured to hold a food item 20. The door 14 is coupled to the cabinet 12, such as through hinges 22 that are attached to both the door 14 and the cabinet 12. The hinges 22 can be articulating hinges. The door 14 is movable to, from, and between a closed position 24 (see, e.g., FIG. 1) and an open position 26 (see, e.g., FIG. 2). In the closed position 24, the door 14 denies access through the opening 18 and into the refrigeration compartment 16 from an external environment 28. In the open position 26, the door 14 allows access through the opening 18 to the refrigeration compartment 16 from the external environment 28. The refrigeration appliance 10 can be a freezer that maintains air and the food item 20 within the refrigeration compartment 16 at a temperature below a freezing point of water, such as within a range of from −18° C. to −23° C. The refrigeration appliance 10 can be a refrigerator that maintains the air and the food item 20 within the refrigeration compartment 16 at a temperature below room temperature but above the freezing point of water, such as within a range of from 2° C. to 4° C. The refrigeration appliance 10 can include multiple refrigeration compartments 16 that are maintained at difference temperatures (e.g., one of the refrigeration compartments 16 as the freezer and another one of the refrigeration compartments 16 as the refrigerator). The refrigeration appliance 10 can be of a built-in variety, where the cabinet 12 is designed to be recessed into cabinetry 30, as illustrated. Alternatively, the refrigeration appliance 10 can be of a stand-alone variety, where the cabinet 12 is designed to be seen from the external environment 28 and thus may include a wrapper (not illustrated) over the cabinet 12.

Referring additionally to FIGS. 3-10, the cabinet 12 provides a forward surface 32. The forward surface 32 faces forward 34. The forward surface 32 faces the door 14 when the door 14 is in the closed position 24. The forward surface 32 is substantially vertical. The opening 18 into the refrigeration compartment 16 is disposed laterally inward of the forward surface 32. For example, the forward surface 32 frames the opening 18. The door 14 forms a seal 36 against the forward surface 32 of the cabinet 12, when the door 14 is in the closed position 24, as further discussed below.

The cabinet 12 includes interior surfaces 38 that define the refrigeration compartment 16. For example, as in the illustrated embodiments, the interior surfaces 38 can be those provided by a rear wall 40, side walls 42, 44, a ceiling 46, and a floor 48 that collectively define the refrigeration compartment 16. The ceiling 46 and the floor 48 oppose each other. The side walls 42, 44 oppose each other. The rear wall 40 and the door 14 oppose each other, when the door 14 is in the closed position 24. The refrigeration compartment 16 is configured to hold the food item 20 in terms of the size of the refrigeration compartment 16 being large enough to hold the food item 20. Further, the refrigeration compartment 16 can include one or more shelves 50 and the like that provide a horizontal surface 52 upon which the food item 20 can sit without falling to the floor 48 or out of the refrigeration compartment 16 when the door 14 is in the open position 26.

In embodiments, the cabinet 12 includes a vacuum-insulated structure 54. The cabinet 12 then can include an inner liner 56, an outer wrapper 58, and a trim breaker 60. The outer wrapper 58 at least partially envelops the inner liner 56. For example, the outer wrapper 58 can include a top section 62 that is disposed above a top section 64 of the inner liner 56, a rear section 66 that is rearward of a rear section 68 of the inner liner 56, opposing side sections 70, 72 that are disposed laterally outward of side sections 74, 76 of the inner liner 56, and so on. In such embodiments, the top section 64 of the inner liner 56 can form the ceiling 46 of the refrigeration compartment 16, the rear section 68 of the inner liner 56 can form the rear wall 40 of the refrigeration compartment 16, and the side sections 74. 76 of the inner liner 56 can form the side walls 42, 44 of the refrigeration compartment 16. In addition to at least partially enveloping the inner liner 56, the outer wrapper 58 of vacuum-insulated structure 54 can provide the forward surface 32 of the cabinet 12 that forms the seal 36 with the door 14, when the door 14 is in the closed position 24.

The trim breaker 60 is coupled to both the inner liner 56 and the outer wrapper 58. For example, as in the illustrated embodiments, the trim breaker 60 includes a forward recess 78 and a rear recess 80. The forward recess 78 is disposed forward 34 relative to the rear recess 80. An edge 82 of the outer wrapper 58 of the vacuum-insulated structure 54 of the cabinet 12 is disposed within the forward recess 78 of the trim breaker 60, to couple the trim breaker 60 and the outer wrapper 58 together. Adhesive (not illustrated) can be utilized to affix the trim breaker 60 and the outer wrapper 58 in an air-tight manner. Similarly, an edge 84 of the inner liner 56 of the vacuum-insulated structure 54 of the cabinet 12 is disposed within the rear recess 80 of the trim breaker 60, to couple the trim breaker 60 and the inner liner 56 together. Again, adhesive (not illustrated) can be utilized to affix the trim breaker 60 and the inner liner 56 in an air-tight manner.

The outer wrapper 58 is separated from the inner liner 56 by a space 86. The space 86 has an air pressure that is less than atmospheric pressure at the external environment 28. The reduced pressure relative to the external environment 28 is a consequence of evacuating air from the space 86 after assembly of vacuum-insulated structure 54. Reducing the amount of air within the space 86 reduces thermal transfer through the space 86. The outer wrapper 58 and the inner liner 56 of the vacuum-insulated structure 54 of the cabinet 12 can be fabricated from sheet metal (either unitary or disparate panels welded together) or a plastic material. The trim breaker 60 can be a plastic material. Insulation material 87 (e.g., fumed silica) can occupy the space 86.

The door 14 includes a vacuum-insulated structure 88. The vacuum-insulated structure 88 of the door 14 can include an inner liner 90 and an outer wrapper 92. The inner liner 90 faces the refrigeration compartment 16, more particularly the rear wall 40 thereof, when the door 14 is in the closed position 24. The outer wrapper 92 faces the external environment 28 and is disposed forward 34 of the inner liner 90, when the door 14 is in the closed position 24. The outer wrapper 92 and the inner liner 90 are separated by a space 94. Like the space 86 of the cabinet 12, the space 94 of the door 14 has an air pressure that is less than atmospheric pressure at the external environment 28. The reduced pressure relative to the external environment 28 is a consequence of evacuating air from the space 94 after assembly of vacuum-insulated structure 88. Reducing the amount of air within the space 94 reduces thermal transfer through the space 94. The inner liner 90 and the outer wrapper 92 can be formed of stamped sheet metal or a plastic material. Insulation material 96 (e.g., fumed silica) can occupy the space 94.

The vacuum-insulated structure 88 of the door 14 further includes a trim breaker 98. The trim breaker 98 is coupled to both the inner liner 90 and the outer wrapper 92 of the vacuum-insulated structure 88 of the door 14. For example, as in the illustrated embodiments, the trim breaker 98 of the door 14 includes an outer forward recess 100 and an inner forward recess 102. The outer forward recess 100 and the inner forward recess 102 are "forward" in the sense that they are open from the forward 34 direction (e.g., away from the refrigeration compartment 16). The outer forward recess 100 is disposed closer to an outer perimeter 104 of the trim breaker 98 than the inner forward recess 102. An edge 106 of the outer wrapper 92 of the door 14 is disposed within the outer forward recess 100 of the trim breaker 98, to couple the trim breaker 98 and the outer wrapper 92 together. Adhesive 108 can be utilized to form an air-tight seal there. An edge 110 of the inner liner 90 of the door 14 is disposed within the inner forward recess 102 of the trim breaker 98, to couple the trim breaker 98 and the inner liner 90 together. Likewise, adhesive (not illustrated) can be utilized to form an air-tight seal there. The trim breaker 98 can be formed of a plastic material.

The door 14 further includes a gasket 114. The gasket 114 forms the seal 36 against the forward surface 32 of the cabinet 12 when the door 14 is in the closed position 24. In embodiments where the cabinet 12 includes the vacuum-insulated structure 54 with the outer wrapper 58 providing the forward surface 32, the gasket 114 forms the seal 36 against the outer wrapper 58. The gasket 114 can include a rearward portion 116 with a magnet 118, a central portion 120, and a forward portion 122. The central portion 120 is disposed between the rearward portion 116 and the forward portion 122. The gasket 114 can be made of a plastic, aside from the magnet 118. The rearward portion 116 can provide a rear surface 124 that is substantially vertical and positioned to interface with and form the seal 36 against the forward surface 32 of the cabinet 12 (e.g., the outer wrapper 58 thereof), when the door 14 is in the closed position 24. The magnet 118 draws the gasket 114 and thus the door 14 to the forward surface 32 of the cabinet 12 to seal 36 the door 14 to the cabinet 12.

The trim breaker 98 of the door 14 further includes a rear recess 126. The rear recess 126 is open from a rearward direction 128. The rear recess 126 is disposed closer to the outer perimeter 104 of the trim breaker 98 than the inner forward recess 102 of the trim breaker 98. The rear recess 126 is disposed further from the outer perimeter 104 than the outer forward recess 100 of the trim breaker 98. The forward portion 122 of the gasket 114 is disposed within the rear recess 126, to couple the trim breaker 98 and the gasket 114 together. The forward portion 122 of the gasket 114 can friction fit into the rear recess 126 to attach the door 14 gasket 114 and the trim breaker 98 together.

The trim breaker 98 of the door 14 further includes a projection 130. The projection 130 extends rearward 128 relative to the inner forward recess 102 and the gasket 114 of the door 14. The projection 130 extends rearward 128 through the opening 18 of the cabinet 12 and into the refrigeration compartment 16 when the door 14 is in the closed position 24. The projection 130 opposes one or more of the interior surfaces 38 of the cabinet 12 that define the refrigeration compartment 16, when the door 14 is in the closed position 24. However, in embodiments, the projection 130 is separated from the interior surfaces 38 by a gap 132. In other words, in those embodiments, the projection 130 does not contact the cabinet 12. However, in other embodiments, the projection 130 may contact the cabinet 12. The gap 132 being present can be advantageous because manufacturing tolerances can cause variations in the dimensions of the cabinet 12 and the door 14. The gap 132 being present allows for such variations to exist without the projection 130 preventing the door 14 from moving to the closed position 24.

In embodiments, such as those illustrated, the trim breaker 60 of the cabinet 12 provides one or more of the interior surfaces 38 of the cabinet 12 that define the refrigeration compartment 16. For example, the trim breaker 60 can form part of the ceiling 46 of the refrigeration compartment 16, along with the inner liner 56. In that instance, the trim breaker 60 forms a forward part 134 of the ceiling 46, and the inner liner 56 may form a remainder 136 of the ceiling 46 of the refrigeration compartment 16. When the door 14 is in the closed position 24, the projection 130 of the trim breaker 98 of the door 14 opposes the trim breaker 60 of the cabinet 12.

The trim breaker 98 has a top section 138 where the projection 130 faces the ceiling 46 of the refrigeration compartment 16. In embodiments, at the top section 138, the trim breaker 98 has a top horizontal wall 142. A top vertical wall 144 extends downward 146 from the top horizontal wall 142. A second horizontal wall 148 extends forward 34 from the top vertical wall 144. A second vertical wall 150 extends downward 146 from the second horizontal wall 148. A third horizontal wall 152 extends rearward 128 from the second vertical wall 150. A fourth horizontal wall 154 extends rearward 128 from the third horizontal wall 152. The trim breaker 98 further includes a downward transition 156 from the third horizontal wall 152 to the fourth horizontal wall 154. A third vertical wall 158 extends downward 146 from the fourth horizontal wall 154. A fifth horizontal wall 160 extends forward 34 from the third vertical wall 158. An angled wall 162 extends rearward 128 and downward 146 from the third vertical wall 158. A fourth vertical wall 164 extends downward 146 from the angled wall 162. A sixth horizontal wall 166 extends forward 34 from the fourth vertical wall 164.

The top horizontal wall 142, the top vertical wall 144, and the second horizontal wall 148 of the trim breaker 98 define the outer forward recess 100 of the trim breaker 98 of the door 14. As mentioned, the edge 106 of the outer wrapper 92 of the door 14 is disposed within the outer forward recess 100 of the trim breaker 98 of the door 14. More particularly, the edge 106 of the outer wrapper 92 is disposed horizontally between the top horizontal wall 142 and the second horizontal wall 148 of the trim breaker 98 and forward 34 of the top vertical wall 144 of the trim breaker 98.

The second horizontal wall 148, the second vertical wall 150, and the third horizontal wall 152 of the trim breaker 98 together define the rear recess 126 of the trim breaker 98 of the door 14. As mentioned, the forward portion 122 of the gasket 114 of the door 14 is disposed within the rear recess 126 to couple the trim breaker 98 and the gasket 114 of the door 14 together. The forward portion 122 of the gasket 114 is disposed rearward 128 of the second vertical wall 150 and between the second horizontal wall 148 and the third horizontal wall 152.

The fourth horizontal wall 154, the third vertical wall 158, and the fifth horizontal wall 160 together define the inner forward recess 102 of the trim breaker 98 of the door 14. As mentioned, the edge 110 of the inner liner 90 of the door 14 is disposed within the inner forward recess 102 to couple the inner liner 90 and the trim breaker 98 of the door 14 together. The edge 110 is disposed horizontally between the fourth horizontal wall 154 and the fifth horizontal wall 160, and forward 34 of the third vertical wall 158.

The angled wall 162, the fourth vertical wall 164, and the sixth horizontal wall 166 of the trim breaker 98 together define the projection 130. As mentioned, the projection 130 opposes one or more of the interior surfaces 38 of the cabinet 12 that define the refrigeration compartment 16, when the door 14 is in the closed position 24. More particularly, in embodiments, the angled wall 162 of the trim breaker 98 opposes one or more of the interior surfaces 38 of the cabinet 12 that define the refrigeration compartment 16.

The gap 132 separating the projection 130 of the trim breaker 98 of the door 14 from the refrigeration compartment 16 (e.g., the ceiling 46, or the portion of the ceiling 46 provided by the trim breaker 60 of the cabinet 12) has a shortest distance 168 between the projection 130 and the surface of the cabinet 12 defining the refrigeration compartment 16, when the door 14 is in the closed position 24. In embodiments, the shortest distance 168 is less than 12 mm. In embodiments, the shortest distance 168 is within a range of from 4 mm to 12 mm. In other embodiments, the shortest distance 168 is zero (e.g., the projection 130 contacts the surface of the cabinet 12 defining the refrigeration compartment 16). In embodiments, the projection 130 extends rearward 128 at least 30 mm from a plane 170 that the forward surface 32 of the cabinet 12 forms.

The refrigeration appliance 10 of the present disclosure addresses the problem set forth in the background of sub-optimally high thermal transfer across the interface (e.g., where the seal 36 is formed) between the door 14 and the cabinet 12 (e.g., from the external environment 28 through the interface and into the refrigeration compartment 16) because the projection 130 of the trim breaker 98 of the door 14 extends into the refrigeration compartment 16 and is separated from the cabinet 12 (e.g., the trim breaker 60 of the vacuum-insulated structure 54 of the cabinet 12) by the gap 132 with the shortest distance 168 that is relatively small. The gap 132 being relatively small hinders air flow from further within the refrigeration compartment 16, through the gap 132, and to the gasket 114 of the door 14 interfacing with the forward surface 32 of the cabinet 12. Hindering the air flow hinders thermal transfer across that interface as well as the flow of relatively cool air across the interface and into the external environment 28. The reduced thermal transfer results in less electricity that the refrigeration appliance 10 has to consume to maintain the temperature of the refrigeration compartment 16 and thus the food item 20.

According to a first aspect, a refrigeration appliance comprises: (a) a cabinet comprising (i) a forward surface that is substantially vertical, (ii) interior surfaces defining a refrigeration compartment configured to hold a food item, and (iii) an opening into the refrigeration compartment disposed inward of the forward surface; and (b) a door coupled to the cabinet, the door comprising (i) a closed position that denies access through the opening and into the refrigeration compartment of the cabinet from an external environment, (ii) an open position that allows access through the opening to the refrigeration compartment from the external environment, the door being movable to, from, and between the closed position and the open position, (iii) an inner liner facing the refrigeration compartment when the door is in the closed position, (iv) an outer wrapper separated from the inner liner by a space, and (v) a trim breaker coupled to both the inner liner and the outer wrapper, the trim breaker comprising a projection that extends rearward into the refrigeration compartment of the cabinet, when the door is in the closed position, wherein, the projection of the trim breaker opposes one or more of the interior surfaces of the cabinet defining the refrigeration compartment, when the door is in the closed position, but is separated therefrom by a gap.

According to a second aspect of the present disclosure, the refrigeration appliance of the first aspect is presented, wherein the cabinet further comprises (i) an inner liner, (ii) an outer wrapper at least partially enveloping the inner liner and separated from the inner liner by a space, and (iii) a trim breaker coupled to both the inner liner and the outer wrapper.

According to a third aspect of the present disclosure, the refrigeration appliance of the second aspect is presented, wherein (i) the outer wrapper provides the forward surface, and (ii) the door further comprises a gasket that forms a seal against the forward surface of the outer wrapper when the door is in the closed position.

According to a fourth aspect of the present disclosure, the refrigeration appliance of any one of the second through third aspects is presented, wherein the space of the cabinet between the inner liner and the outer wrapper has an air pressure than is less than atmospheric pressure.

According to a fifth aspect of the present disclosure, the refrigeration appliance of any one of the second through fourth aspects is presented, wherein the trim breaker of the cabinet comprises (i) a forward recess within which an edge of the outer wrapper of the cabinet is disposed to couple the trim breaker and the outer wrapper of the cabinet together and (ii) a rear recess within which an edge of the inner liner of the cabinet is disposed to couple the trim breaker and the inner liner of the cabinet together.

According to a sixth aspect of the present disclosure, the refrigeration appliance of any one of the second through fifth aspects is presented, wherein the trim breaker of the cabinet provides one or more of the interior surfaces of the cabinet defining the refrigeration compartment that the projection of the trim breaker of the door opposes when the door is in the closed position.

According to a seventh aspect of the present disclosure, the refrigeration appliance of the sixth aspect is presented, wherein the one or more interior surfaces of the cabinet defining the refrigeration compartment that the trim breaker of the cabinet provides and that the projection of the trim breaker of the door opposes form part of a ceiling of the refrigeration compartment.

According to an eighth aspect of the present disclosure, the refrigeration appliance of any one of the first through seventh aspects is presented, wherein the space of the door between the inner liner and the outer wrapper has an air pressure that is less than atmospheric pressure.

According to a ninth aspect of the present disclosure, the refrigeration appliance of any one of the first through eighth aspects is presented, wherein (a) the trim breaker of the door further comprises (i) an outer forward recess within which an edge of the outer wrapper of the door is disposed and (ii) an inner forward recess within which an edge of the inner liner of the door is disposed, the outer forward recess disposed closer to an outer perimeter of the trim breaker than the inner forward recess, and (b) the projection extends rearward relative to the inner forward recess and into the refrigeration compartment of the cabinet.

According to a tenth aspect of the present disclosure, the refrigeration appliance of the ninth aspect is presented, wherein (i) the trim breaker of the door further comprises a rear recess disposed closer to the outer perimeter than the inner forward recess but further from the outer perimeter than the outer forward recess, and (ii) a forward portion of a gasket of the door is disposed within the rear recess to couple the trim breaker and the gasket together.

According to an eleventh aspect of the present disclosure, the refrigeration appliance of any one of the first through tenth aspects is presented, wherein the trim breaker of the door further comprises, at a top section thereof, (i) a top horizontal wall, (ii) a top vertical wall that extends downward from the top horizontal wall, (iii) a second horizontal wall that extends forward from the top horizontal wall, (iv) a second vertical wall that extends downward from the second horizontal wall, (v) a third horizontal wall that extends forward from the second vertical wall, (vi) a fourth horizontal wall that extends forward from the third horizontal wall, (vii) a downward transition from the third horizontal wall to the fourth horizontal wall, (viii) a third vertical wall that extends downward from the fourth horizontal wall, (ix) a fifth horizontal wall that extends rearward from the third vertical wall, (x) an angled wall that extends rearward and downward from the third vertical wall, (xi) a fourth vertical wall that extends downward from the angled wall, and (xii) a sixth horizontal wall that extends rearward from the fourth vertical wall.

According to a twelfth aspect of the present disclosure, the refrigeration appliance of the eleventh aspect is presented, wherein the top horizontal wall, the top vertical wall, and the second horizontal wall define an outer forward recess within which an edge of the outer wrapper of the door is disposed, with the edge of the outer wrapper of the door disposed horizontally between the top horizontal wall and the second horizontal wall and forward of the top vertical wall.

According to a thirteenth aspect of the present disclosure, the refrigeration appliance of any one of the eleventh through twelfth aspects is presented, wherein the second horizontal wall, the second vertical wall, and the third horizontal wall define a rear recess within which a forward portion of a gasket of the door is disposed to couple the trim breaker and the gasket of the door together.

According to a fourteenth aspect of the present disclosure, the refrigeration appliance of any one of the eleventh through thirteenth aspects is presented, wherein the fourth horizontal wall, the third vertical wall, and the fifth horizontal wall define an inner forward recess within which an edge of the inner liner of the door is disposed.

According to a fifteenth aspect of the present disclosure, the refrigeration appliance of any one of the eleventh through fourteenth aspects is presented, wherein the fourth horizontal wall, the third vertical wall, and the fifth horizontal wall define an inner forward recess within which an edge of the inner liner of the door is disposed.

According to a sixteenth aspect of the present disclosure, the refrigeration appliance of any one of the eleventh through fifteenth aspects is presented, wherein the angled wall of the trim breaker of the door opposes the one or more interior surfaces of the cabinet defining the refrigeration compartment.

According to a seventeenth aspect of the present disclosure, the refrigeration appliance of any one of the first through sixteenth aspects is presented, wherein the door further comprises a gasket comprising (i) a forward portion coupled to the trim breaker and (ii) a rearward portion that provides a rear surface that is substantially vertical and positioned to interface with and form a seal against the forward surface of the outer wrapper when the door is in the closed position.

According to an eighteenth aspect of the present disclosure, the refrigeration appliance of the seventeenth aspect is presented, wherein the forward portion of the gasket of the door is disposed within a rear recess of the trim breaker of the door to couple the gasket and the trim breaker together.

According to a nineteenth aspect of the present disclosure, the refrigeration appliance of any one of the first through eighteenth aspects is presented, wherein the gap has a shortest distance that is less than 12 mm.

According to a twentieth aspect of the present disclosure, a refrigeration appliance comprises (a) a cabinet comprising a vacuum-insulated structure within which a refrigeration compartment configured to hold a food item is disposed; and (b) a door comprising a vacuum-insulated door structure coupled to the cabinet, the vacuum-insulated door comprising (i) a gasket that forms a seal against the vacuum-insulated cabinet when the door is in a closed position and (ii) a projection inward of the gasket that projects into the refrigeration compartment and is separated from the vacuum-insulated cabinet by a gap, the gap having a shortest distance that is less than 12 mm.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A refrigeration appliance comprising:

a cabinet comprising (i) a forward surface that is substantially vertical, (ii) interior surfaces defining a refrigeration compartment configured to hold a food item, and (iii) an opening into the refrigeration compartment disposed inward of the forward surface; and a door coupled to the cabinet, the door comprising a closed position that denies access through the opening and into the refrigeration compartment of the cabinet from an external environment, an open position that allows access through the opening to the refrigeration compartment from the external environment, the door being movable to, from, and between the closed position and the open position, an inner liner facing the refrigeration compartment when the door is in the closed position, an outer wrapper separated from the inner liner by a space, and a trim breaker coupled to both the inner liner and the outer wrapper, the trim breaker comprising a projection that extends rearward into the refrigeration compartment of the cabinet, when the door is in the closed position, wherein, the projection of the trim breaker opposes one or more of the interior surfaces of the cabinet defining the refrigeration compartment, when the door is in the closed position, but is separated therefrom by a gap, and wherein, the trim breaker of the door further comprises, at a top section thereof, (i) a top horizontal wall, (ii) a top vertical wall that extends downward from the top horizontal wall, (iii) a second horizontal wall that extends forward from the top vertical wall, (iv) a second vertical wall that extends downward from the second horizontal wall, (v) a third horizontal wall that extends rearward from the second vertical wall, (vi) a fourth horizontal wall that extends rearward from the third horizontal wall, (vii) a downward transition from the third horizontal wall to the fourth horizontal wall, (viii) a third vertical wall that extends downward from the fourth horizontal wall, (ix) a fifth horizontal wall that extends forward from the third vertical wall, (x) an angled wall that extends rearward and downward from the third vertical wall, (xi) a fourth vertical wall that extends downward from the angled wall, and (xii) a sixth horizontal wall that extends forward from the fourth vertical wall.

2. The refrigeration appliance of claim 1, wherein the cabinet further comprises (i) an inner liner, (ii) an outer wrapper at least partially enveloping the inner liner of the cabinet and separated from the inner liner of the cabinet by a space, and (iii) a trim breaker coupled to both the inner liner of the cabinet and the outer wrapper of the cabinet.

3. The refrigeration appliance of claim 2, wherein the outer wrapper of the cabinet provides the forward surface, and the door further comprises a gasket that forms a seal against the forward surface of the outer wrapper of the cabinet when the door is in the closed position.

4. The refrigeration appliance of claim 2, wherein the space of the cabinet between the inner liner of the cabinet and the outer wrapper of the cabinet has an air pressure that is less than atmospheric pressure.

5. The refrigeration appliance of claim 2, wherein the trim breaker of the cabinet comprises (i) a forward recess within which an edge of the outer wrapper of the cabinet is disposed to couple the trim breaker of the cabinet and the outer wrapper of the cabinet together and (ii) a rear recess within which an edge of the inner liner of the cabinet is disposed to couple the trim breaker of the cabinet and the inner liner of the cabinet together.

6. The refrigeration appliance of claim 2, wherein the trim breaker of the cabinet provides one or more of the interior surfaces of the cabinet defining the refrigeration compartment that the projection of the trim breaker of the door opposes when the door is in the closed position.

7. The refrigeration appliance of claim 6, wherein the one or more interior surfaces of the cabinet defining the refrigeration compartment that the trim breaker of the cabinet provides and that the projection of the trim breaker of the door opposes form part of a ceiling of the refrigeration compartment.

8. The refrigeration appliance of claim 1, wherein the space of the door between the inner liner of the door and the outer wrapper of the door has an air pressure that is less than atmospheric pressure.

9. The refrigeration appliance of claim 1, wherein the trim breaker of the door further comprises (i) an outer forward recess within which an edge of the outer wrapper of the door is disposed and (ii) an inner forward recess within which an edge of the inner liner of the door is disposed, the outer forward recess disposed closer to an outer perimeter of the trim breaker of the door than the inner forward recess, and the projection of the trim breaker of the door extends rearward relative to the inner forward recess of the trim breaker of the door and into the refrigeration compartment of the cabinet.

10. The refrigeration appliance of claim 9, wherein the trim breaker of the door further comprises a rear recess disposed closer to the outer perimeter of the trim breaker of the door than the inner forward recess of the trim breaker of the door but further from the outer perimeter of the trim breaker of the door than the outer forward recess of the trim breaker of the door, and a forward portion of a gasket of the door is disposed within the rear recess of the trim breaker of the door to couple the trim breaker of the door and the gasket together.

11. The refrigeration appliance of claim 1, wherein the top horizontal wall, the top vertical wall, and the second horizontal wall of the trim breaker of the door define an outer forward recess within which an edge of the outer wrapper of the door is disposed, with the edge of the outer wrapper of the door disposed horizontally between the top horizontal wall of the trim breaker of the door and the second horizontal wall of the trim breaker of the door and forward of the top vertical wall of the trim breaker of the door.

12. The refrigeration appliance of claim 1, wherein the second horizontal wall, the second vertical wall, and the third horizontal wall of the trim breaker of the door define a rear recess within which a forward portion of a gasket of the door is disposed to couple the trim breaker of the door and the gasket of the door together.

13. The refrigeration appliance of claim 1, wherein the fourth horizontal wall, the third vertical wall, and the fifth horizontal wall of the trim breaker of the door define an inner forward recess within which an edge of the inner liner of the door is disposed.

14. The refrigeration appliance of claim 13, wherein the inner forward recess of the trim breaker of the door is disposed elevationally higher than the angled wall of the trim breaker of the door.

15. The refrigeration appliance of claim 1, wherein the angled wall, the fourth vertical wall, and the sixth horizontal wall of the trim breaker of the door define the projection.

16. The refrigeration appliance of claim 1, wherein the angled wall of the trim breaker of the door opposes the one or more interior surfaces of the cabinet defining the refrigeration compartment.

17. The refrigeration appliance of claim 1, wherein the door further comprises a gasket comprising (i) a forward portion coupled to the trim breaker of the door and (ii) a rearward portion that provides a rear surface that is substantially vertical and positioned to interface with and form a seal against the forward surface of the outer wrapper of the cabinet when the door is in the closed position.

18. The refrigeration appliance of claim 17, wherein the forward portion of the gasket of the door is disposed within a rear recess of the trim breaker of the door to couple the gasket of the door and the trim breaker of the door together.

19. The refrigeration appliance of claim 1, wherein the gap has a shortest distance that is less than 12 mm.

20. The refrigeration appliance of claim 13, wherein the top horizontal wall, the top vertical wall, and the second horizontal wall of the trim breaker of the door define an outer forward recess within which an edge of the outer wrapper of the door is disposed, with the edge of the outer wrapper of the door disposed horizontally between the top horizontal wall and the second horizontal wall of the trim breaker of the door and forward of the top vertical wall of the trim breaker of the door, the angled wall, the fourth vertical wall, and the sixth horizontal wall of the trim breaker of the door define the projection, and the inner forward recess of the trim breaker of the door is elevationally between the outer forward recess of the trim breaker of the door and the angled wall of the trim breaker of the door.

* * * * *